United States Patent [19]

Neal et al.

[11] Patent Number: 4,529,087

[45] Date of Patent: Jul. 16, 1985

[54] PRINTED ANTISTATIC PLASTIC BAG

[75] Inventors: Robert Neal, Sebattus; Robert Ray, Auburn, both of Me.

[73] Assignee: Maine Poly, Inc., Greene, Me.

[21] Appl. No.: 544,387

[22] Filed: Oct. 21, 1983

[51] Int. Cl.[3] ..... B65D 73/02; B65D 85/42

[52] U.S. Cl. ..... 206/328; 428/215; 428/922

[58] Field of Search ..... 428/922, 215; 361/220, 361/212; 206/313, 334, 328

[56] References Cited

U.S. PATENT DOCUMENTS

| | | | |
|---|---|---|---|
| 3,223,554 | 2/1965 | Newman | 428/922 |
| 3,801,418 | 4/1974 | Corneus et al. | 428/922 |
| 4,154,344 | 5/1979 | Venni, Jr. et al. | 206/328 |
| 4,211,324 | 7/1980 | Ohlbach | 206/328 |
| 4,267,927 | 5/1981 | English, Jr. | 206/328 |
| 4,336,093 | 6/1982 | Kohayakawa et al. | 428/922 |
| 4,424,900 | 1/1984 | Petcavich | 206/328 |

*Primary Examiner*—Joseph Man-Fu Moy

*Attorney, Agent, or Firm*—Auslander & Thomas

[57] ABSTRACT

An antistatic sheet or bag for electrostatic sensitive devices is obtained by uniformly mixing a thermoplastic polymer such as polyethylene with about 0.1 to 0.7 per cent by weight of an antistat, extruding the mixture in the form of a tubular sheet, subjecting the sheet to a corona discharge, printing on the sheet or both sides of a tube forming said sheet, with a carbon conducting ink, cutting the sheet into units of desired length and sealing the end of each such cut unit to form a bag.

14 Claims, 5 Drawing Figures

PRINTED ANTISTATIC PLASTIC BAG

This invention relates to containers such as plastic bags for holding electronic equipment. It particularly relates to plastic bags which protect static-electric sensitive components from degradation or destruction caused by a discharge of static electricity.

PRIOR ART

The need to protect static-electrical sensitive materials from damage by electrostatic discharge is well recognized, and containers for such purposes have been developed. The products now on the market, such as, for example, Simco-Stat Barrier Bags of Simco, RCAS 3600 of Richmond, and 3M's brand of "Transparent Shielding Bags," are multi-layered bags comprised of two to three layers—an inner antistatic layer, which may be comprised of one or two layers, and a metallic coated outer layer. Such bags are also disclosed in U.S. Pat. No. 4,154,344. The combination of the antistatic inner layer with the metallic coated outer layer prevents the generation of static electricity within the bag and provides a Faraday cage to shield against static from external sources.

The preparation of antistatic polyalkylene materials such as, for example, polyethylene, polypropylene and copolymers of ethylene and propylene is well known in the art. U.S. Pat. Nos. 3,703,569 and 3,219,408 describe the preparation of thermoplastic polymeric sheets containing an antistatic material from the above-mentioned polymers. Suitable antistatic materials included tertiary amines, anionic phosphate esters, quaternary ammonium halides and sulfonated aliphatic hydrocarbons. The antistatic properties of these antistat containing polymers were further enhanced by subjecting them to a corona discharge.

The thermoplastic polymer sheets described in the U.S. Pat. Nos. 3,703,569 and 3,219,408 contained less than 0.1% by weight of an antistat. When such sheets were subjected to a corona discharge of about 0.145 KW, the static decay half life of the sheet is about 160 seconds. While the inclusion of more antistat (of up to about 0.5 to 0.7% by weight) will result in reducing the static half life to about 26 seconds, according to this disclosure, even in the absence of the corona treatment it is reported in the U.S. Pat. No. 3,703,569 that the inclusion of so much antistat adversely affected the adhesion of inks and glues used in printing and bonding, to the polymeric sheet. There is no disclosure in either the U.S. Pat. No. 3,219,408 or the U.S. Pat. No. 3,703,569 that a thermoplastic sheet containing more than 0.1% weight of an antistat can be treated in any way to overcome the poor adhesion thereto of inks or glues. Because of this poor adhesion, conductive ink has not been able to be effectively printed on a sheet, container or bag to impart conductive properties to dissipate a static electric charge. The Bemis Condulon® bag may have an imprint of conductive ink. The ink, though, is thinly printed and protected between laminations of plastic in order for it not to be rubbed off or fall off. The lamination eliminates much of the effectiveness of the use of a conductive ink for the dissipation of static electric charge.

THE PRESENT INVENTION

It is accordingly an object of this invention to provide a thermoplastic container or bag of single layer construction having both antistatic and conductive properties.

It is another object of this invention to provide for use in such container or bag a thermoplastic polymer sheet containing therein an antistatic material and having a static discharge half life of the order of about less than one second, in a bag which accepts the printing thereon of at least conductive inks.

It is a further object of this invention to provide a thermoplastic bag comprised of a plastic containing an antistatic material and having printed on its outer surface a Faraday cage of conductive ink.

It is still another object of this invention to provide a process for the preparation of such thermoplastic antistatic and conductive bags.

In accordance with this invention there is provided a thermoplastic polymer sheet, usually in the form of a tube, formable into a bag comprised of polyethylene, polypropylene or a copolymer of ethylene and propylene, containing from about 0.1 to 0.7% by weight of an antistat, and printed in conductive ink on its outside to form a Faraday cage.

In accordance with this invention, it has been found that the treatment of a thermoplastic polymeric sheet comprised of polyethylene, polypropylene, or a copolymer of ethylene and propylene, containing from about 0.1 to 0.7% by weight of an antistatic material, with a corona discharge of 40 to 50 dynes will enable such treated sheet to retain printed matter thereon particularly conductive ink. Treatment with a corona discharge of about 0.145 to 0.290 KW is also effective. Suitable antistats in the practice of this invention include tertiary amines such as trialkyl amines, bis-(hydroxyalkyl)-alkylamines, and the like, quaternary ammonium halides, anionic phosphate esters and sulfonated aliphatic hydrocarbons. A preferred antistat is a bis-(hydroxyethyl)-alkylumine sold by Armour Industrial Chemical Co., Chicago, Ill., under the name ARMOSTAT 310.

A static electric sensitive device in a bag made in accordance with the present invention can easily withstand a 5 KV static charge, dissipated in much less than the standard required two seconds. The bag of the present invention also shields the contents from low levels of electromagnetic eneregy waves 20 to 30 Bb at 20 to 900 MgHZ.

Although such novel feature or features believed to be characteristic of the invention are pointed out in the claims, the invention and the manner in which it may be carried out, may be further understood by reference to the description following and the accompanying drawings.

It is to be understood that the illustrations in the drawings and the Examples are given by way of example and are not to be considered as limiting.

DETAILED DESCRIPTION

In the drawings.

Referring now to the figures in greater detail, where like reference numbers denote like parts in the various figures.

EXAMPLE 1

Figure 1:
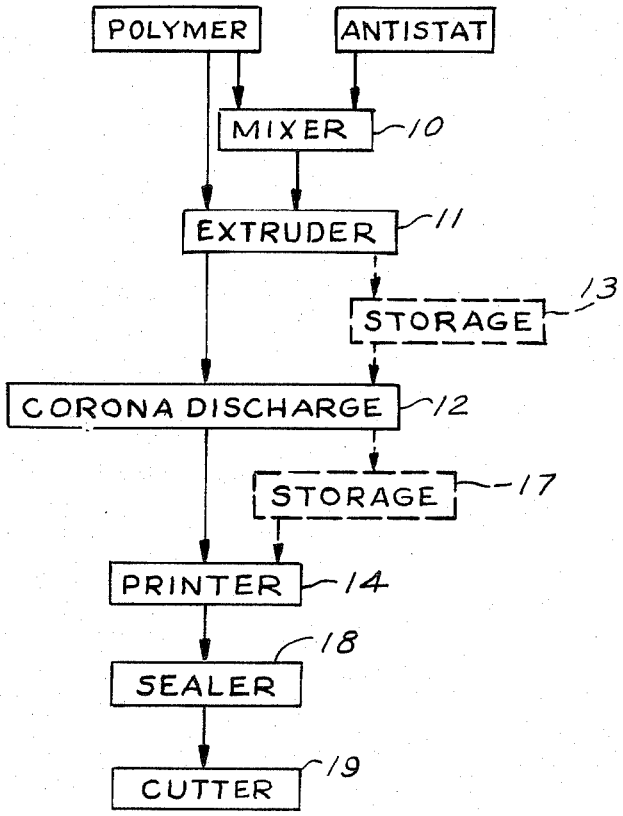
FIG. 1 is a block diagram illustrating the process of this invention.
Figure 3:
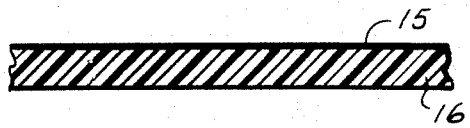
FIG. 3 is a sectional view along the line 3—3 of FIG. 2.
Figure 4:
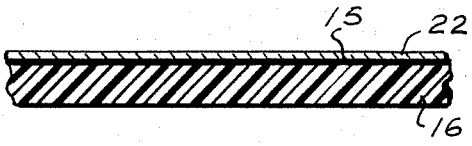
FIG. 4, is a sectional view corresponding to FIG. 3 of another embodiment of this invention.
Figure 2:
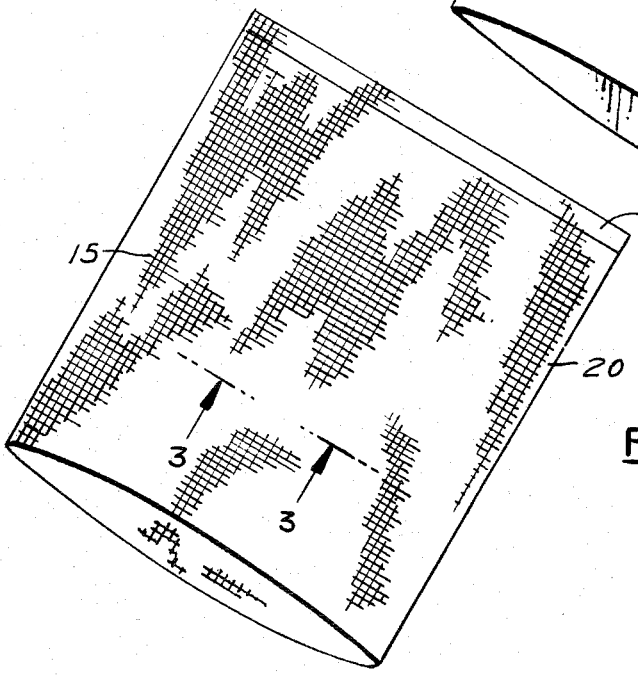
FIG. 2 is a perspective view of a bag of this invention.

To a high density (0.96 g/cc) polyethylene having a high melt index of 1.0 (as measured by ASTM Standard D 1238-62T) in a mixer 10 was added 0.5% by weight of ARMOSTAT 310 and the materials mixed till the mixture was substantially uniform. The material was then put through an extruder 11 to obtain a tubular sheet of material of desired dimensions. Both sides of the tubular sheet were subjected to a corona discharge 12 of about 0.145 KW using a Lepel Treater Unit HFS6-2 available from Lepel High Frequency Laboratories, Inc., New York, N.Y. If desired, the sheet of extruded material may be rolled up and stored 13 before being subjected to the corona discharge. Such storing serves to effect an increase in the discharge rate of static electricity by the tubular sheet material. After being subjected to the corona discharge, the sheet is passed through a printer 14 and a grid pattern 15, as shown in FIGS. 2 and 3, of a carbon conducting ink, is printed first on one flat outer surface of the tubular sheet 16 and then on the flat other side. The sheet may be reversed in any suitable manner to effect the printing on both sides, or may be passed through multiple print stationery. Although the tube is printed as a flat sheet, the printing on one surface of the sheet provides a bleed which completely joins the grid pattern printed on the opposite outer surface of the tubular sheet to form a Faraday cage. A printer suitable for use in the practice of this invention is a Flexograph® Press obtained from Hudson Sharpe of Wisconsin. A suitable carbon conductive ink is 63-354 Conductive Carbon Black available from otham Ink & Color Company, Inc., Long Island City, New York.

EXAMPLE 2

The procedure of Example 1 was repeated using 0.1% by weight of ARMOSTAT 310.

EXAMPLE 3

The procedure of Example 1 was repeated using 0.7% by weight of ARMOSTAT 310.

EXAMPLE 4

The procedure of Example 1 was repeated using a corona discharge of 0.250 KW.

EXAMPLE 5

The procedure of Example 1 was repeated using 0.6% by weight of ARMOSTAT 375, a solid form of ARMOSTAT 310, containing about 75% by weight thereof, in place of ARMOSTAT 310.

EXAMPLE 6

The procedure of Example 1 was repeated using a copolymer of ethylene and propylene having a density of 0.896 g/cc in place of the polyethylene.

If desired, the sheet may be rolled and stored 17 after being subjected to the corona discharge before being passed through the printer.

After printing, the tube is sealed by a sealer 18 at one end and the tube is cut in a cutter 19 to form a bag 20 with a sealed bottom portion 21. The sealing is preferably a heat sealing which may be performed simultaneously with the cutting.

If desired, preferably before the cutting operation is effected, a clear lacquer or varnish coating 22 may be sprayed, or otherwise applied, over the printed grid 15. This, however, is not necessary to improve the stability or adhesion of the printed matter, but to preserve the conductive ink against heavy wear.

The grid pattern 15 contains about thirty-five horizontal and vertical lines per linear inch. A preferred grid is twenty-five lines per inch. The smaller the grid, the better, limited only by the need to be able to view what is in the bag. It may vary between thirty to forty lines per inch without affecting the visibility of the object contained in the bag or the conductivity of the grid.

Figure 5:
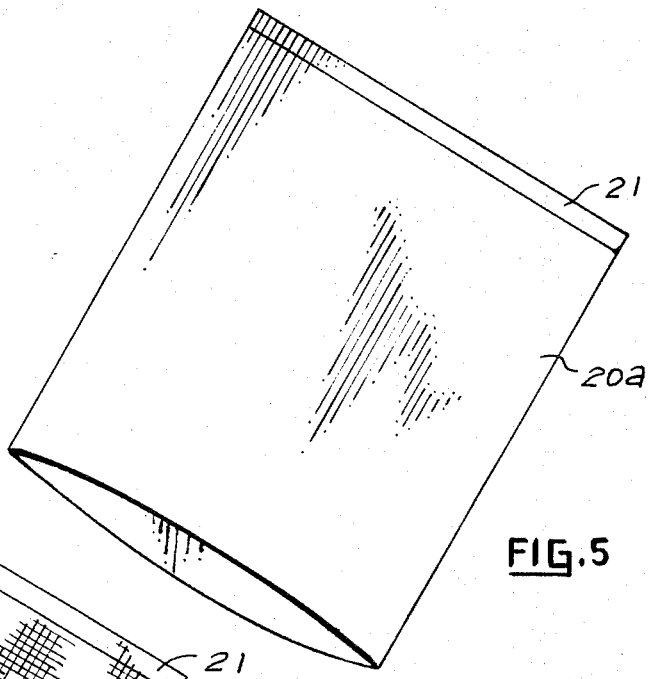
FIG. 5 is another embodiment of the bag of the present invention.

As shown in FIG. 5, a bag 20*a* is provided with a solid imprint of conductive ink, in lieu of the grid pattern 15. Where visibility into the bag is not required, a solid imprint, without gaps, provides an even better antistatic means of discharge.

Bags prepared according to this invention were measured for their electrostatic decay properties using the Electro Tech Systems Model 406B static decay system in accordance with Federal Test Standard 101B, Method 4046. The average decay time of the charge after its application was less than one second, frequently less than 0.5 second. The exterior conductive carbon layer is discharged in less than 0.0005 seconds.

Bags prepared according to this invention were measured for static protection of components inside them. Using the following test method a probe from a Simco electo-static locater Model SS2X was inserted inside a bag whose exterior conductive layer was attached to an electrical ground and static voltages ranging from 40 to 80 thousand volts were applied to the exterior surface, repeated discharges resulted in zero meter defelctions.

When packages comprised of the bags of this invention were subjected to a bounce test in accordance with MIL-STD-810C, Method 514.2, Procedure XI, it was found that there was no damage to the packages, thus showing the sturdiness of the bags.

The terms and expressions which are employed are used as terms of description; it is recognized, though, that various modifications are possible.

The terms and expressions which are employed are used as terms of description; it is recognized, though, that various modifications are possible.

It is also understood the following claims are intended to cover all of the generic and specific features of the invention herein described; and all statements of the scope of the invention as a matter of language, might fall therebetween.

Having described certain forms of the invention in some detail, what is claimed is:

1. An antistatic sheet for the rapid dissipation of an electrostatic charge, said sheet comprised of a thermoplastic polymer selected from the group consisting of polyethylene, polypropolyene and copolymers of ethylene and propylene, said polymer having uniformly distributed therein from about 0.1 to about 0.7 percent by weight of an antistat selected from the group consisting a tertiary amine, an anionic phosphate ester a quaternary ammonium halide, and a sulfonated aliphatic hydrocarbon, said sheet having been subjected to a corona discharge and having an imprint of carbon conducting ink thereon adapted to rapidly dissipate an electrostatic charge.

2. A sheet according to claim 1 formed into a tube.

3. A tube according to claim 2 formed into a bag closed at least at one end.

4. The invention according to claim 1 wherein said imprint thereon is in the form a grid.

5. The invention according to claim 2 wherein said imprint thereon is in the form a grid.

6. The invention according to claim 1 wherein said imprint thereon is substantially without gaps.

7. The invention according to claim 2 wherein said imprint thereon is substantially without gaps.

8. The invention according to claim 5 or 7 wherein said imprint thereon is a grid in the form of a Faraday cage.

9. The invention according to claims 1 or 2 wherein the polymer is polyethylene.

10. The invention according to claim 9 wherein the antistat is a tertiary amine.

11. The invention according to claim 10 wherein the tertiary amine is a bis-(hydroxyethyl)-alkylamine.

12. The invention according to claim 10 wherein the tertiary amine is present in an amount of about 0.5 percent by weight.

13. The invention according to claims 4 or 5 wherein the grid is comprised of about 20 to about 40 horizontal lines and about 20 to about 40 vertial lines per linear inch.

14. The invention according to claims 4 or 5 wherein the grid is comprised of 25 horizontal and 25 vertical lines per linear inch.

* * * * *